US008438670B2

(12) United States Patent
Grover et al.

(10) Patent No.: US 8,438,670 B2
(45) Date of Patent: May 14, 2013

(54) HIGH PERFORMANCE SIPHONIC TOILET CAPABLE OF OPERATION AT MULTIPLE FLUSH VOLUMES

(75) Inventors: David Grover, Hamilton, NJ (US); Zheng Chen, Flemington, NJ (US); James McHale, Hillsborough, NJ (US)

(73) Assignee: AS IP Holdco, LLC, Piscataway, NJ (US)

( * ) Notice: Subject to any disclaimer, the term of this patent is extended or adjusted under 35 U.S.C. 154(b) by 18 days.

(21) Appl. No.: 12/547,458

(22) Filed: Aug. 25, 2009

(65) Prior Publication Data

US 2010/0043130 A1 Feb. 25, 2010

Related U.S. Application Data

(60) Provisional application No. 61/182,603, filed on May 29, 2009, provisional application No. 61/091,647, filed on Aug. 25, 2008.

(51) Int. Cl.
*E03D 11/02* (2006.01)

(52) U.S. Cl.
USPC ..... 4/421; 4/425; 4/324; 4/325

(58) Field of Classification Search ..... 4/420, 421, 4/425, 324–326
See application file for complete search history.

(56) References Cited

U.S. PATENT DOCUMENTS

| | | | | |
|---|---|---|---|---|
| 5,400,445 | A | 3/1995 | Hull | |
| 5,647,068 | A | 7/1997 | Jensen | |
| 5,711,039 | A | 1/1998 | Mizrahi | |
| 5,918,325 | A | 7/1999 | Arita et al. | |
| 5,983,413 | A | 11/1999 | Hayashi et al. | |
| 6,715,162 | B2 | 4/2004 | Han et al. | |
| 6,782,564 | B1 | 8/2004 | Cheng | |
| 6,823,535 | B2 | 11/2004 | Tomita et al. | |
| 7,900,290 | B2 * | 3/2011 | Han | 4/325 |
| 2004/0040080 | A1 * | 3/2004 | Prokopenko et al. | 4/420 |
| 2007/0113331 | A1 | 5/2007 | Prokopenko et al. | |
| 2008/0060121 | A1 | 3/2008 | Andreiu | |
| 2009/0007323 | A1 | 1/2009 | Campbell et al. | |
| 2009/0241250 | A1 | 10/2009 | Grover | |
| 2012/0174310 | A1 * | 7/2012 | Grover et al. | 4/425 |

FOREIGN PATENT DOCUMENTS

| | | | |
|---|---|---|---|
| CN | 1171141 | A | 1/1998 |
| CN | 2421344 | Y | 2/2001 |
| CN | 1369601 | A | 9/2002 |

OTHER PUBLICATIONS

PCT International Search Report and Written Opinion, International Application No. PCT/US2009/054968, Dated Oct. 15, 2009, 8 pages.
PCT International Preliminary Report on Patentability, International Application No. PCT/US2009/054968, Dated Mar. 1, 2011, 8 pages.
The State Intellectual Property Office of the People's Republic of China, Notification of First Office Action (English Translation and attached Chinese Version), Nov. 19, 2012, 6 pages.

* cited by examiner

*Primary Examiner* — Gregory Huson
*Assistant Examiner* — Janie Christiansen
(74) *Attorney, Agent, or Firm* — Flaster/Greenberg P.C.

(57) ABSTRACT

A gravity flush toilet system is provides that includes a toilet bowl assembly having a toilet bowl and a tank, wherein the bowl includes a trapway extending from the bottom of the toilet bowl to a sewage line. The toilet system is capable of operating at multiple flush volumes without loss of siphonic function or significant change in the surface area of the water in the bowl. The multiple flush volumes allow the user to select appropriate water usages for the required waste removal without diminishing the performance of the toilet, resulting in significant water savings.

21 Claims, 6 Drawing Sheets

HIGH PERFORMANCE SIPHONIC TOILET CAPABLE OF OPERATION AT MULTIPLE FLUSH VOLUMES

CROSS-REFERENCE TO RELATED APPLICATIONS

This patent application claims the benefit under 35 U.S.C. §19(e) of U.S. provisional patent applications Ser. No. 61/182,603, filed May 29, 2009, and No. 61/091,647, filed Aug. 25, 2008, the disclosures of which are incorporated herein by reference in their entirety.

BACKGROUND OF THE INVENTION

1. Field of the Invention

The invention relates to the field of siphonic, gravity-powered toilets for the removal of human and other waste, and more specifically to a toilet having a dual flushing system.

2. Description of Related Art

Toilets for removing waste products, such as human waste, are well known. Gravity-powered toilets generally have two main parts: a tank and a bowl. The tank and bowl can be separate pieces, which are coupled together to form the toilet system (commonly referred to as a two-piece toilet), or can be combined into one integral unit (typically referred to as a one-piece toilet).

The tank, which is usually positioned over the back of the bowl, contains water that is used for initiating flushing of waste from the bowl into a sewage line, as well as for refilling of the bowl with fresh water. When a user desires to flush the toilet, he initiates a flushing mechanism, by pushing down on a flush lever on the outside of the tank, which is connected on the inside of the tank to a movable chain or lever. When the flush lever is depressed, it moves a chain or lever on the inside of the tank, which acts to lift and open a flush valve, causing water to flow from the tank into the bowl, thus initiating the toilet flush.

There are three general purposes to be served in a flush cycle. The first is removal of solid or other waste to a drain line. The second is cleansing of the bowl to remove any solid or liquid waste deposited or adhered to the surfaces of the bowl. The third is replenishing the pre-flush water volume in the bowl so that relatively clean water remains in the bowl between uses and that a sufficient seal is formed to prevent sewer gases from flowing into the room. The second requirement, cleansing the bowl, is usually achieved by way of a rim that extends around an upper perimeter of the toilet bowl that defines a rim channel running through the rim around the perimeter. Some or all of the flush water is directed through this rim channel and flows through openings positioned in the rim providing liquid communication between the channel and the bowl so as to disperse water over the entire surface of the bowl and accomplish the required cleansing.

Gravity-powered toilets fall generally into two categories: wash down and siphonic. In a wash-down toilet, the water level within the bowl of the toilet remains relatively constant at all times. When a flush cycle is initiated, water flows from the tank and spills into the bowl. This causes a rapid rise in water level and the excess water spills over the weir of the trapway, carrying liquid and solid waste along with it. At the conclusion of the flush cycle, the water level in the bowl naturally returns to the equilibrium level determined by the height of the weir.

In a siphonic toilet, the trapway and other hydraulic channels are designed such that a siphon is initiated in the trapway upon addition of water to the bowl. The siphon tube itself is an upside down curved, generally U-shaped tube that draws water from the toilet bowl to the wastewater line. When the flush cycle is initiated, water flows into the bowl and spills over the weir in the trapway faster than it can exit the outlet to the sewer line. Sufficient air is eventually removed from the down leg of the trapway to initiate a siphon, which in turn pulls the remaining water by vacuum out of the bowl. The water level in the bowl when the siphon breaks is consequently well below the level of the weir, and a separate mechanism needs to be provided to refill the bowl of the toilet at the end of a siphonic flush cycle to reestablish the original water level and protective "seal" against back flow of sewer gas.

Siphonic and wash-down toilets each have inherent advantages and disadvantages. Wash-down toilets can function with larger trapways than siphonic toilets, but generally require a smaller amount of pre-flush water in the bowl to achieve the 100:1 dilution level required by plumbing codes in most countries (That is, 99% of the pre-flush water volume in the bowl must be removed from the bowl and replaced with fresh water during the flush cycle). This small pre-flush volume manifests itself as a small "water spot." The water spot, or surface area of the pre-flush water in the bowl, plays an important role in maintaining the cleanliness of a toilet and reducing odors. A large water spot increases the probability that waste matter will contact water before contacting the ceramic surface of the toilet. This reduces adhesion of waste matter to the ceramic surface making it easier for the toilet to clean itself via the flush cycle. Wash-down toilets with their small water spots therefore frequently require manual cleaning of the bowl after use. The adhesion of waste material above the water line also leads to a greater level of unpleasant smell during use.

Siphonic toilets, due to the requirement that most of the air be removed from the down leg of the trapway in order to initiate a siphon, tend to have smaller trapways which can result in clogging. Siphonic toilets have the advantage of being able to function with a greater pre-flush water volume in the bowl and greater water spot. This is possible because the siphon action pulls the majority of the pre-flush water volume from the bowl at the end of the flush cycle. As the tank refills, a portion of the refill water is directed into the bowl to return the pre-flush water volume to its original level. In this manner, the 100:1 dilution level required by many plumbing codes is achieved even though the starting volume of water in the bowl is significantly higher relative to the flush water exited from the tank. In the North American markets, siphonic toilets have gained widespread acceptance and are now viewed as the standard, accepted form of toilet. In European markets, wash-down toilets are still more accepted and popular. Whereas both versions are common in the Asian markets.

Gravity-powered siphonic toilets generally fall into three categories, depending on the design of the hydraulic channels used to achieve the flushing action. These categories are: non-jetted, rim jetted, and direct jetted.

In non-jetted bowls, all of the flush water exits the tank and enters the bowl through a "tank inlet area" in the bowl and flows through a manifold into the rim channel. The water is dispersed around the perimeter of the bowl via a series of holes positioned underneath the rim. Some of the holes are designed to be larger in size to allow greater flow of water into the bowl. A relatively high flow rate is needed to spill water over the weir of the trapway rapidly enough to displace sufficient air in the down leg and initiate the siphon. Non-jetted bowls typically have adequate to good performance with respect to cleansing of the bowl and replenishment of the pre-flush water, but are relatively poor in performance in terms of bulk removal. The feed of water to the trapway is inefficient and turbulent, which makes it more difficult to sufficiently fill the down leg of the trapway and initiate a strong siphon. Consequently, the trapway of a non-jetted toilet is typically smaller in diameter and contains bends and constrictions designed to impede flow of water. Without the smaller size, bends, and constrictions, a strong siphon would not be achieved. Unfortunately, the smaller size, bends, and constrictions result in poor performance in terms of bulk waste removal and frequent clogging, conditions that are extremely dissatisfying to end users.

Designers and engineers of toilets have improved the bulk waste removal of siphonic toilets by incorporating "jets." In a rim-jetted toilet bowl, the flush water exits the tank through the tank inlet area and flows through a manifold into the rim channel. A portion of the water is dispersed around the perimeter of the bowl via a series of holes positioned underneath the rim. The remaining portion of water flows through a jet channel positioned at the front of the rim. This jet channel connects the rim channel to a jet opening positioned in the sump of the bowl. The jet opening is sized and positioned to send a powerful stream of water directly at the opening of the trapway. When water flows through the jet opening, it serves to fill the trapway more efficiently and rapidly than can be achieved in a non-jetted bowl. This more energetic and rapid flow of water to the trapway enables toilets to be designed with larger trapway diameters and fewer bends and constrictions, which, in turn, improves the performance in bulk waste removal relative to non-jetted bowls. Although a smaller volume of water flows out of the rim of a rim-jetted toilet, the bowl cleansing function is generally acceptable as the water that flows through the rim channel is pressurized. This allows the water to exit the rim holes with higher energy and do a more effective job of cleansing the bowl.

Although rim-jetted bowls are generally superior to non-jetted, the long pathway that the water must travel through the rim to the jet opening dissipates and wastes much of the available energy. Direct-jetted bowls improve on this concept and can deliver even greater performance in terms of bulk removal of waste. In a direct-jetted bowl, the flush water exits the tank through the tank inlet area in the bowl and flows through a manifold. At this point, the water is divided into two portions: a portion that flows through the rim channel with the primary purpose of achieving the desired bowl cleansing, and a portion that flows through a second "direct jet channel" that connects the manifold to a jet opening in the sump of the toilet bowl. The direct jet channel can take different forms, sometimes being unidirectional around one side of the toilet, or being "dual fed," wherein symmetrical channels travel down both sides connecting the manifold to the jet opening. As with the rim-jetted bowls, the jet opening is sized and positioned to send a powerful stream of water directly at the opening of the trapway. When water flows through the jet opening, it serves to fill the trapway more efficiently and rapidly than can be achieved in a non-jetted or rim jetted bowl. This more energetic and rapid flow of water to the trapway enables toilets to be designed with even larger trapway diameters and minimal bends and constrictions, which, in turn, improves the performance in bulk waste removal relative to non-jetted and rim jetted bowls.

Several inventions have been aimed at improving the performance of siphonic toilets through optimization of the direct-jetted concept. For example, U.S. Pat. No. 5,918,325 suggests improving performance of a siphonic toilet by improving the shape of the trapway. U.S. Pat. No. 6,715,162 suggests improving performance by the use of a flush valve with a radius incorporated into the inlet and asymmetrical flow of the water into the bowl.

However, given the increasing demands for environmental water conservation, there is still a need for improvement. Government agencies have continually demanded that municipal water users reduce the amount of water they use. Much of the focus in recent years has been to reduce the water demand required by toilet flushing operations. In order to illustrate this point, the amount of water used in a toilet for each flush has gradually been reduced by governmental agencies from 7 gallons/flush (prior to the 1950's), to 5.5 gallons/flush (by the end of the 1960's), to 3.5 gallons/flush (in the 1980's). The National Energy Policy Act of 1995 now mandates that toilets sold in the United States use water in an amount of only 1.6 gallons/flush (6 liters/flush). Regulations have recently been passed in the State of California that require water usage to be lowered ever further to 1.28 gallons/flush. The 1.6 gallons/flush toilets currently described in the patent literature and available commercially lose the ability to consistently siphon when pushed to these lower levels of water consumption.

Thus, there is significant need in the art for a toilet system that enables lower water usage without sacrificing performance in terms of bulk removal and cleanliness of the bowl.

One potential route to fulfilling the above-noted need in the art is through the use of toilet systems that are capable of operating at multiple flush volumes. For example, "dual flush" toilets are now commercially available that offer two flush cycles. The user of the toilet can select a "full flush" of, for example, 1.6 gallons for removal of solid waste or a "short flush" of, for example, 1.1 gallons for the removal of liquid or minimal solid waste. Assuming that toilets are used roughly twice as often for removal of liquid waste than removal of solid waste, this representative dual flush system results in an average water usage, $V_{avg}$, of $$(2V_{pf}+V_{ff})/3 \quad \text{(I)}$$

wherein $V_{pf}$ is the volume of a partial (or lower volume) flush and $V_{ff}$ is the volume of the full flush. In the example above regarding typical flush volumes wherein gpf is gallons/flush, $$V_{avg}=(2\cdot 1.1\text{ gpf}+1.6\text{ gpf})/3=1.27\text{ gpf} \quad \text{(II)}$$

This corresponds to a 21% savings over a single-flush, 1.6 gallons per flush system.

Recently, the U.S. Environmental Protection Agency introduced a WaterSense program that certifies toilets that use less than or equal to 1.28 gpf (20% or greater savings over 1.6 gpf) as "High Efficiency Toilets," or HETs. Regional programs that offer rebates for purchasing WaterSense certified HETs are growing in popularity and will drive consumers towards the purchase of these products.

However, the dual flush toilets currently available in the world market are lacking in some dimension of toilet performance. In fact, truly siphonic dual flush toilets do not exist. Dual flush toilets are commercially available but function primarily as wash-down systems and suffer problems associated with maintenance of bowl cleanliness as discussed above. In the U.S. market, where siphonic toilets are the norm, consumer reluctance to accept wash-down dual flush toilets will slow the efforts of the U.S. government to reduce water usage through the WaterSense program.

The technical challenge in designing truly siphonic dual flush toilets has been two-fold: The first is designing a toilet capable of siphoning consistently on very low (<1.28 gpf) flush volumes. The second is in finding a way to consistently refill the bowl after varying flush cycles. As mentioned above, the level of water in the bowl of a gravity-powered siphonic toilet system falls below the level of the weir after the break of the siphon. The water level must be restored to its original level or at minimum to the 2 inch (5.08 cm) seal depth required by plumbing codes throughout North America, Europe, and Asia. This refilling is accomplished by directing into the bowl a predetermined percentage of the water required to refill the tank. This predetermined percentage is referred to as the "refill ratio." The system and refill ratio are tuned such that the level of water in the bowl reaches its required seal depth at nearly the same time that the water level in the tank reaches its required depth and the fill valve is closed. The closing of the fill valve is usually controlled by means of a float inside the tank. When the tank water level reaches its target height, the float rises on the surface of the water and mechanically closes the fill valve.

With a dual flush toilet system, a different volume of water will flow from the tank depending on the flush cycle the user selects. For example, when the full cycle (6 liters per flush (lpf)) is selected, approximately 4.5 liters of water will flow from the tank and 1.5 liters of the water originally in the bowl will be siphoned down the drain along with it. The refill ratio must therefore be set to direct 1.5 liters of water back into the bowl during the time it takes to return 4.5 liters to the tank. The refill ratio in this example is then 1.5 liters/6.0 liters=25%. Setting the refill ratio at 25% will result in maintenance of seal depth and proper function of the toilet system when the full flush cycle is activated. To further the example, when the short flush is selected, approximately 3.3 liters of water will flow from the tank and 1.5 liters of the water originally in the bowl will be siphoned down the drain along with it. After the flush, the tank only needs to replenish 3.3 liters of water. If the same 25% refill ratio is used, only 1.1 liters will be returned to the bowl, leaving it short of its code required seal depth. The solution to this problem is not obvious, and toilet manufacturers have been forced to turn to wash-down systems that circumvent the issue by eliminating the need for refill.

There is therefore, a need in the art for a siphonic toilet system that provides high-performance waste removal, while solving the refill issue and minimizing clogging, and still allowing for conservation of water use.

BRIEF SUMMARY OF THE INVENTION

Therefore, the present invention provides a toilet and a gravity flush toilet system that avoids the aforementioned disadvantages of the prior art and provides a siphonic toilet system that can provide water savings through its capability of operating at multiple flush volumes. Another advantage of the present invention is to provide a siphonic toilet system capable of operating with multiple and variable flush volumes, while having a larger surface area of water in the bowl to help maintain cleanliness and reduce odors.

Another advantage of the present invention is to provide a toilet with a flushing mechanism capable of providing superior exchange of pre-flush water in the bowl, cleaner appearance between uses, and improved hygiene. The invention further advantageously provides a toilet system enabling water conservation without compromise in any area of performance.

The invention includes a gravity flush toilet system having at least two flush volumes, comprising a toilet bowl having an outlet and a tank, wherein the tank comprises at least one fill valve and at least one flush valve, the system provides a surface area of water in the toilet bowl of at least about 200 $cm^2$, a peak flow rate measured at an outlet of the bowl during a siphon of at least about 2500 ml/s during a full flush cycle, and a flow rate of at least 2000 ml/s is achieved in no more than about 1.75 seconds from initiation of the full flush cycle. Furthermore, the toilet bowl is capable of refilling at the end of a flush cycle, with reduced water volume, to achieve a seal depth that is greater than about 5 cm and a post-flush surface area of water in the bowl that is at least about 90% of the area obtained after completion of the full flush cycle.

In one embodiment, the at least one fill valve in the tank has a refill ratio of greater than about 5% on a full flush cycle and greater than about 10% on a partial flush cycle, wherein the system is capable of substantially restoring the seal depth and surface area of water in the bowl.

The system may have at least one flush cycle that delivers no greater than about 6.0 liters. The system may also have at least one flush cycle that delivers no greater than about 4.2 liters. In one embodiment herein, the system has two flush cycles, a first cycle capable of delivering no greater than about 6.0 liters and a second cycle capable of delivering no greater than about 4.5 liters. In another embodiment the toilet system is capable of providing two flush cycles, wherein a first flush cycle is capable of delivering no greater than about 4.8 liters and a second flush cycle is capable of delivering no greater than about 4.0 liters. A preferred peak flow rate measured at an outlet of the bowl during a siphon may further exceed about 2750 ml/second, and a preferred time to achieve the peak flow rate is 1.5 seconds or less.

In yet a further embodiment herein, the gravity flush toilet system may include at least one of the at least one fill valves in the tank which is capable of diverting a variable percentage of water to refill the toilet bowl based on the flush cycle.

In yet a further embodiment, the toilet system is a direct fed jet toilet system. In such a system, in one further preferred embodiment, internal cross-sectional area measurements within the toilet system are defined by the following relationships:

$$A_{pm}>35\ cm^2>A_{jip}>A_{jop}>6.4\ cm^2 \quad \text{(III)}$$

$$A_{pm}>35\ cm^2>A_{rip}>A_{jop}>6.4\ cm^2>A_{rop} \quad \text{(IV)}$$

where $A_{pm}$ is a cross-sectional area of a primary manifold, $A_{jip}$ is a cross-sectional area of a jet inlet port, $A_{jop}$ is a cross-sectional area of a jet outlet port, $A_{rip}$ is a cross-sectional area of a rim inlet port, and $A_{rop}$ is a cross-sectional area of an at least one rim outlet port.

In a further embodiment, the toilet system may be a rim fed jet toilet system. In yet a further preferred embodiment, in such rim fed jet toilet system, internal cross-sectional area measurements within the toilet system are defined by the following relationships:

$$A_{pm}>35\ cm^2>A_{jip}>A_{jop}>6.4\ cm^2>A_{rop} \quad \text{(V)}$$

where $A_{pm}$ is a cross-sectional area of a primary manifold, $A_{jip}$ is a cross-sectional area of a jet inlet port, $A_{jop}$ is a cross-sectional area of a jet outlet port, and $A_{rop}$ is a cross-sectional area of an at least one rim outlet port.

The invention also includes a method for providing at least two flush volumes to a gravity flush toilet, wherein that toilet includes a toilet bowl having an outlet, a tank, at least one fill valve and at least one flush valve, the method comprising providing a surface area of water in the toilet bowl of at least about 200 $cm^2$; providing a peak flow rate measured at an outlet of the bowl during a siphon of at least about 2500 ml/s; and refilling the toilet bowl at the end of a flush cycle, regardless of flush volume of the at least two flush volumes so as to achieve a seal depth that is greater than about 5 cm and a post-flush surface area of water in the bowl of at least about 90% of the surface area obtained after the highest volume flush cycle.

Various other advantages, and features of the present invention will become readily apparent from the ensuing detailed description and the novel features will be particularly pointed out in the appended claims.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments, which are presently preferred. It should be understood, however, that the invention is not limited to the precise arrangements and instrumentalities shown. In the drawings.

DETAILED DESCRIPTION OF THE INVENTION

Figure 1:
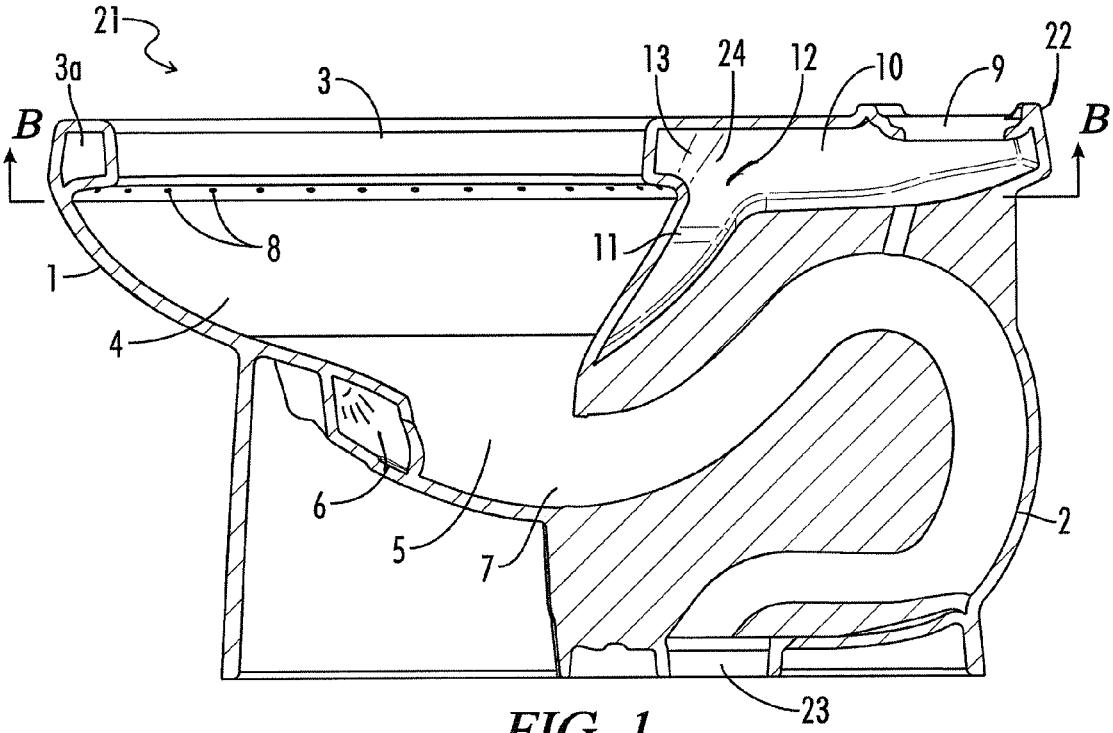
FIG. 1 is a longitudinal cross-sectional representation taken along line A-A of FIG. 1A herein of a direct fed jet toilet according to one embodiment of the invention herein.

The invention provides a toilet, as described herein, which can be operated at multiple water volumes without diminishment in its ability to remove waste, cleanse the bowl, and protect users from exposure to sewer gas. It further provides a siphonic toilet system allowing for high-performance flushing with respect to bulk waste removal, bowl cleansing, and replenishment or exchange of pre-flush water at varying water usages below 6 liters/flush. The toilet maintains the level of resistance to clogging available from existing 6 liters/flush toilets and delivers superior bowl cleanliness while reducing water usage. The water level in the toilet bowl consistently returns to its required seal depth after the flush cycle, regardless of the flush cycle chosen. Furthermore, the toilet provides a sufficiently large surface area of water in the bowl, thereby offering the cleanliness and odor reduction expected from typical siphonic toilets.

In actual practice, due to the level of precision of currently available fill valves, short term variation in water pressure, the chaotic nature of the flushing process itself, and other factors, there will be some inherent variability in the amount of water in any toilet after completion of a flush cycle. If in general, however, this variability can be kept to a level that provides a surface area of water that varies less than 10% between full and partial flush cycles, it would have an inconsequential impact to the performance of the toilet and would go substantially if not completed unnoticed by the end user. Greater variability negatively impacts performance and cleanliness and increases the risk of sewer gases infiltrating the living space around the toilet. Thus, it is highly desirable to have a toilet system that can achieve, after a partial flush, at least 90% of the surface area of water in the bowl that would result from a full flush.

In accordance with the present invention, a new and improved toilet system is provided which includes a toilet bowl assembly having a toilet bowl and a trapway extending from the bottom of the toilet bowl to a sewage line. The toilet bowl has a rim along an upper perimeter of toilet bowl that accommodates a pressurized flow of flush water for cleansing the bowl. The tank is fitted with a flush valve or flush valves capable of releasing more than one predetermined volume of water to the bowl and a fill valve capable of refilling the tank and bowl to their proper levels after the flush cycle. The fill valve can have a single, optimally tuned refill ratio or provide a variable refill ratio that is dependant on the chosen flush cycle. In all embodiments, the multiple flush volume toilet system offers the large water surface area, seal depth, bulk removal performance, cleanliness, and odor suppression expected from siphonic toilets. Said flush valves and fill valves are commercially available.

In addition to the need for specialized flush valves and refill valves, the toilet itself, and indeed the entire toilet system, needs to be engineered to function properly as a siphonic dual flush. The internal hydraulic channels of the toilet must be designed such that the siphon is initiated as rapidly as possible. Any water that exits the trapway before initiation of the siphon is essentially wasted and does not contribute its available potential energy to the flush. This need to rapidly initiate the siphon becomes critical when flush volumes are reduced to 4.5 liters and below, as is desirable for the partial flush cycle of a dual flush toilet. Initiating the siphon quickly enables to bowl to be completely cleansed and purged of waste on a minimal amount of water The siphonic action of a toilet can be characterized by recording of a "discharge curve." The discharge curve can be recorded by positioning a collection reservoir on an electronic scale, and allowing the discharged water from the outlet of the toilet to enter the collection reservoir. When the scale is connected to a PC equipped with a data collection system, one can obtain a reading of the mass of water discharged as a function of time in the flush cycle. The first derivative of this curve reveals the peak discharge rate and time required to reach a given flow rate. Such discharge curves are fairly widely used to characterize the flushing behavior of toilets in the sanitaryware industry (see for example, U.S. Pat. No. 5,918,325, incorporated in relevant part herein by reference). To function effectively as a siphonic dual flush, the inventors have found that the siphon must be initiated in less than about 1.75 seconds from the initiation of the flush cycle, and more preferably, should be initiated in less than about 1.5 seconds. Furthermore, the peak discharge rate should exceed about 2500 ml/s, and more preferably, it should exceed 2750 ml/s.

To achieve this level of hydraulic performance in a gravity powered toilet, it is necessary to incorporate a feature known as a siphon jet. A siphon jet is a distinct hydraulic pathway that directs a powerful stream of water towards the opening of the trapway. This stream of water serves to fill the trapway faster and facilitate the initiation of a siphon. There are two general configurations for a siphon-jetted toilet: a rim fed jet and a direct fed jet. In a rim fed jet toilet, the water flows from the tank, through the bowl inlet and into a primary manifold. It then flows through the rim, either being split to travel both sides of the rim in parallel, or being directed tangentially to one side or the other. As the water approaches the front section of the rim (opposite the opening to the trapway, which is generally in the back section of the toilet bowl), it is directed through a separate channel that connects the rim channel to a jet outlet port. From this jet outlet port then exits the powerful stream that assists in initiating the siphon. In the second type of jetted toilet, a direct fed jet, water flows from the tank through the bowl inlet and into a primary manifold. It is then divided into two or more distinct channels, some of which are directed to the rim of the toilet to provide water for washing the bowl. The rest of the water flows into channels which lead to the jet outlet port in a more direct fashion than that found in a rim fed jetted toilet. The result, in general, is that a direct fed jet toilet provides a stronger flow through the jet outlet port and will consequently have greater bulk removal capability than a rim fed jetted toilet. However, if properly engineered, both design approaches can be used to produce commercially viable toilets that meet end-user expectations.

Figure 1A:
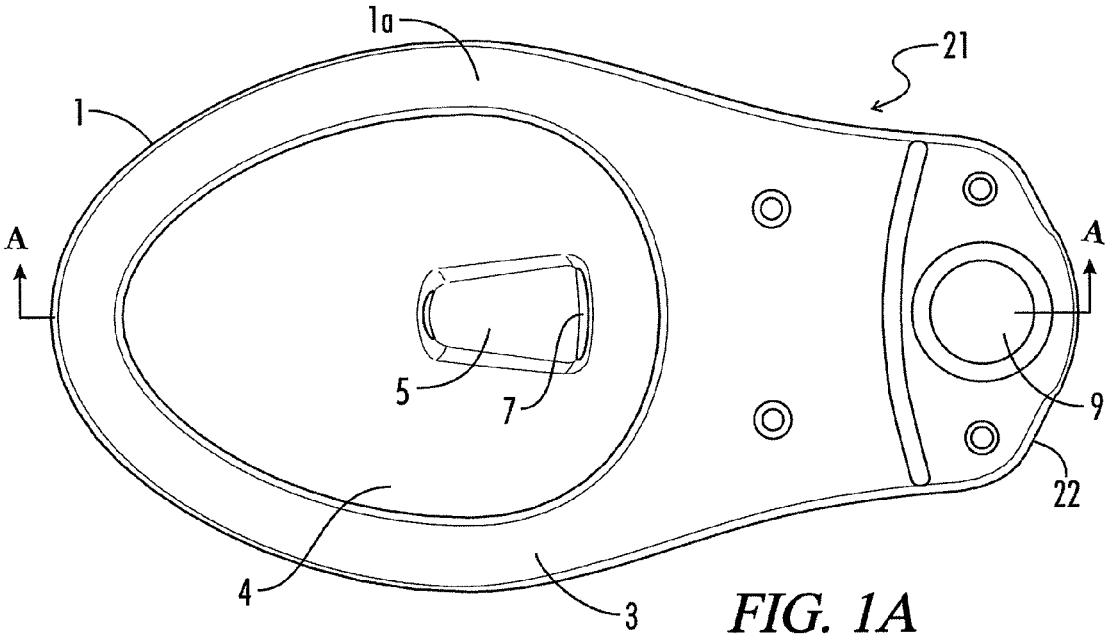
FIG. 1A is a top plan view of the direct fed jet toilet according to the embodiment of the invention in FIG. 1.
Figure 1B:
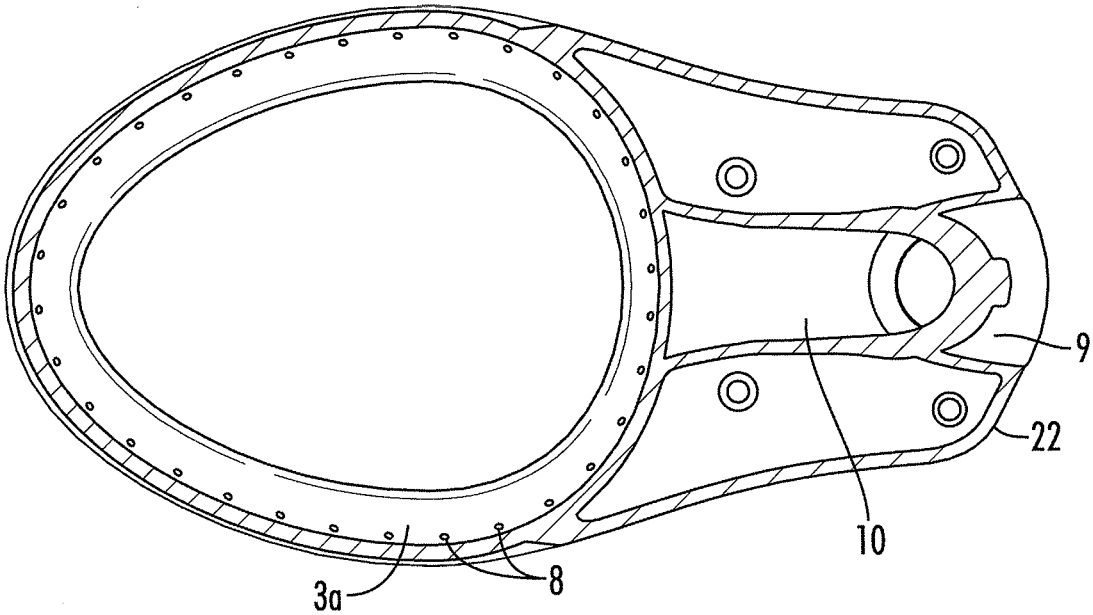
FIG. 1B is a transverse cross-sectional view of the direct fed jet toilet of FIG. 1 taken along line B-B.

Although a siphon jet is a necessary feature for creating a toilet with the hydraulic performance required for application as a siphonic dual flush, it is insufficient in and of itself if not properly designed. There are several features within the hydraulic pathway of the siphon-jetted toilet that must be optimized. Referring now to FIGS. 1, 1A and 1B, a first portion (toilet bowl portion) of a gravity-powered siphonic toilet system with a direct fed jet, generally referred to herein as 21, in accordance with an embodiment of the present invention is shown. As will be explained in more detail below, this toilet delivers exceptional bulk waste removal and bowl cleansing at multiple flush water volumes below 1.6 gallons/flush.

As shown in FIG. 1, the direct fed jet toilet system 21 includes a toilet 1. A trapway 2 is also provided at the bottom of the bowl 4 of toilet 1. The toilet 1 has a rim 3 around the perimeter of the upper surface 1*a* of the toilet 1 that defines a rim channel 3*a*. The bowl 4 of the toilet 1 further has a sump 5 at the bottom thereof as well as a jet outlet port 6 for introducing pressurized water into the trapway opening 7. Rim outlet ports 8 extending through the rim 3 are provided to support liquid communication between the interior of the rim 3 in rim channel 3*a* and the bowl 4. The bowl inlet port 9 sits at the back 22 of the toilet 1. The bowl inlet port 9 empties into a primary manifold 10 and then into a direct jet channel 11 through a jet inlet port 12, and to rim inlet ports 13.

Figure 3:
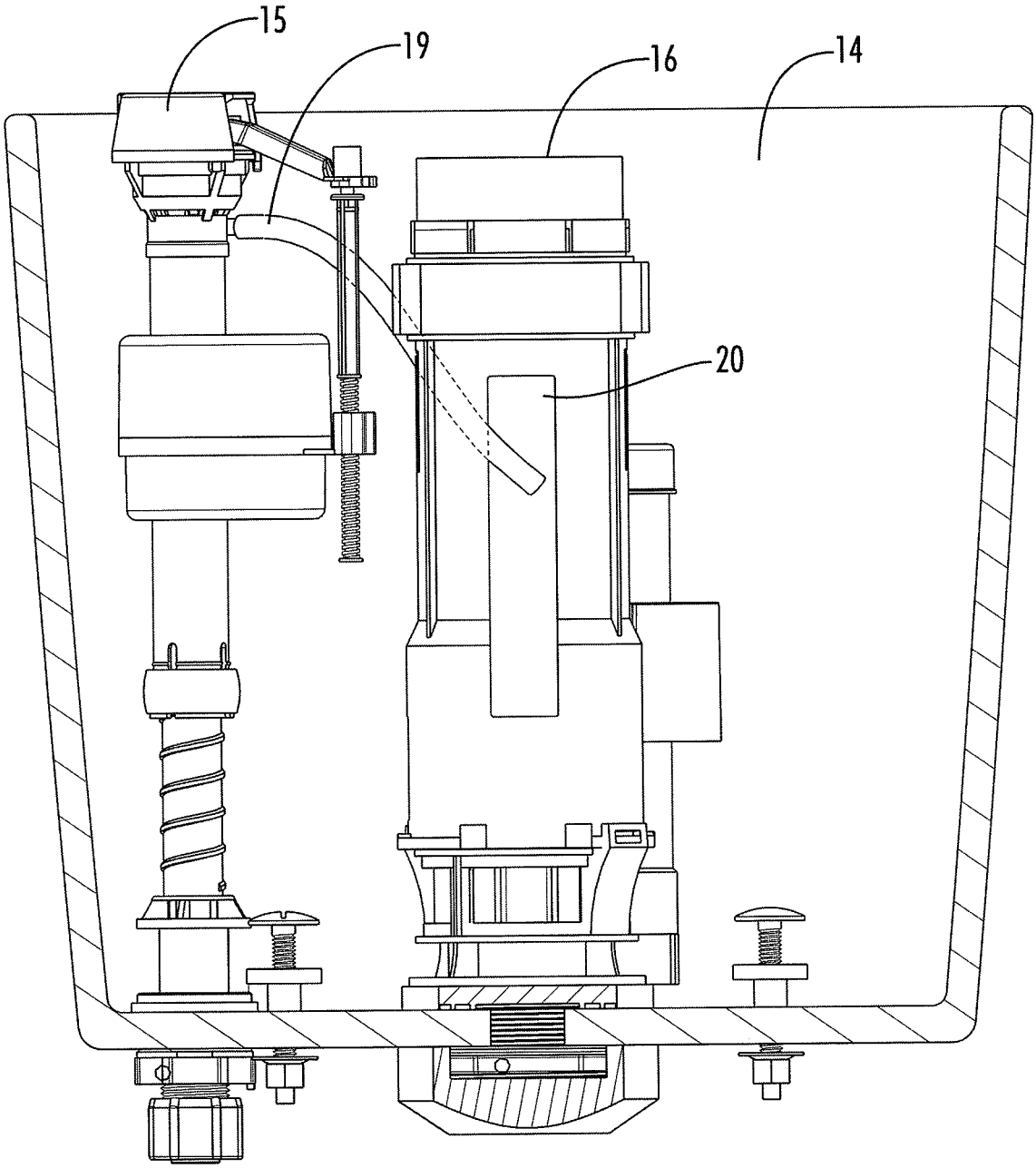
FIG. 3 is longitudinal cross sectional view of a tank open to expose a view of a dual flush mechanism for use in one embodiment of the invention herein.
Figure 3A:
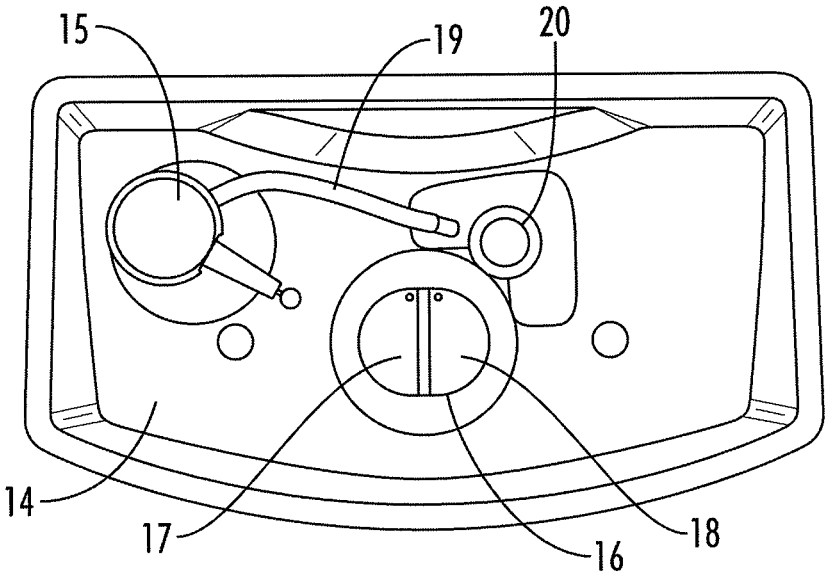
FIG. 3A is a top view of the inside of the tank of FIG. 3.

The tank 14, which is a further portion of toilet system 21 and as in FIGS. 3 and 3A, may be shaped as a standard toilet tank using multiple configurations and coupled above the back 22 of the toilet over the bowl inlet port 9. Alternatively, tank 14 could be formed so as to be integral with the body of the toilet 1, but would preferably be located in the same position, i.e., above the bowl inlet port 9. The tank in use would contain water used to initiate siphoning from the bowl of water and/or waste (liquid or solid) to the sewage line, which would connect to outlet 23 (shown in FIG. 1), as well as a valve mechanism (see FIG. 3) for refilling the bowl with fresh water after a flush cycle.

In the direct fed jet toilet 21, flush water passes from a water tank to the bowl 4 of the toilet 1 through the bowl inlet port 9 and into the primary manifold 10. At the end 24 of primary manifold 10, the water is divided. A portion of the water flows through the jet inlet port 12 into the direct jet channel 11. The remaining portion flows through the rim inlet port 13 into the rim channel 3*a*. The water in the direct jet channel 11 flows to the jet outlet port 6 in the sump 5 and directs a strong, pressurized stream of water at the trapway opening 7. This strong pressurized stream of water is capable of rapidly initiating a siphon in the trapway 2 to evacuate the bowl 4 of the toilet 1 and its contents to the sewer line. The water that flows through the rim channel 3*a* causes a strong, pressurized stream of water to exit the rim holes 8, which serves to cleanse the bowl during the flush cycle.

To function as a siphonic dual flush toilet, there are several key relationships that must be maintained in the geometrical features of a direct fed jet toilet. Maintaining these relationships within the following limits makes it possible to produce a toilet that can achieve a peak flow rate of >2500 ml/s while reaching a flow rate that exceeds 2000 ml/s in less than about 1.75 seconds after initiation of the flush cycle. These geometrical relationships are:

$$A_{pm}>35\ \text{cm}^2>A_{jip}>A_{jop}>6.4\ \text{cm}^2 \quad \text{(I)}$$

$$A_{pm}>35\ \text{cm}^2>A_{rip}>A_{jop}>6.4\ \text{cm}^2>A_{rop} \quad \text{(IV)}$$

where $A_{pm}$ is the cross-sectional area of the primary manifold, $A_{jip}$ is the cross-sectional area of the jet inlet port, $A_{jop}$ is the cross-sectional area of the jet outlet port, $A_{rip}$ is the cross-sectional area of the rim inlet port, and $A_{rop}$ is the cross-sectional area of the rim outlet port(s). Holding the size of the internal water chambers within these limits creates a system with optimal flow characteristics.

When the transverse cross-sectional area of the primary manifold is below about 35 $cm^2$, the flow of water exiting the tank is constricted, which will prevent the system from achieving the rapid and strong siphon necessary for a toilet to function adequately as a siphonic dual flush. Similarly, when the area of the jet outlet port is less than about 6.4 $cm^2$ or other relationships in equations (III) and/or (IV) are not maintained, the flow of water is constricted and a rapid formation of a powerful siphon cannot be maintained. There is also an upper limit on the size of these ports and channels, above which the sheer volume of water necessary to fill them sufficiently to transfer pressure and energy to the trapway becomes infeasible on six or fewer liters of water. Due to aesthetic and manufacturing constraints, however, this limit is less likely to become an issue than construction due to insufficient size of channels and ports.

Figure 2:
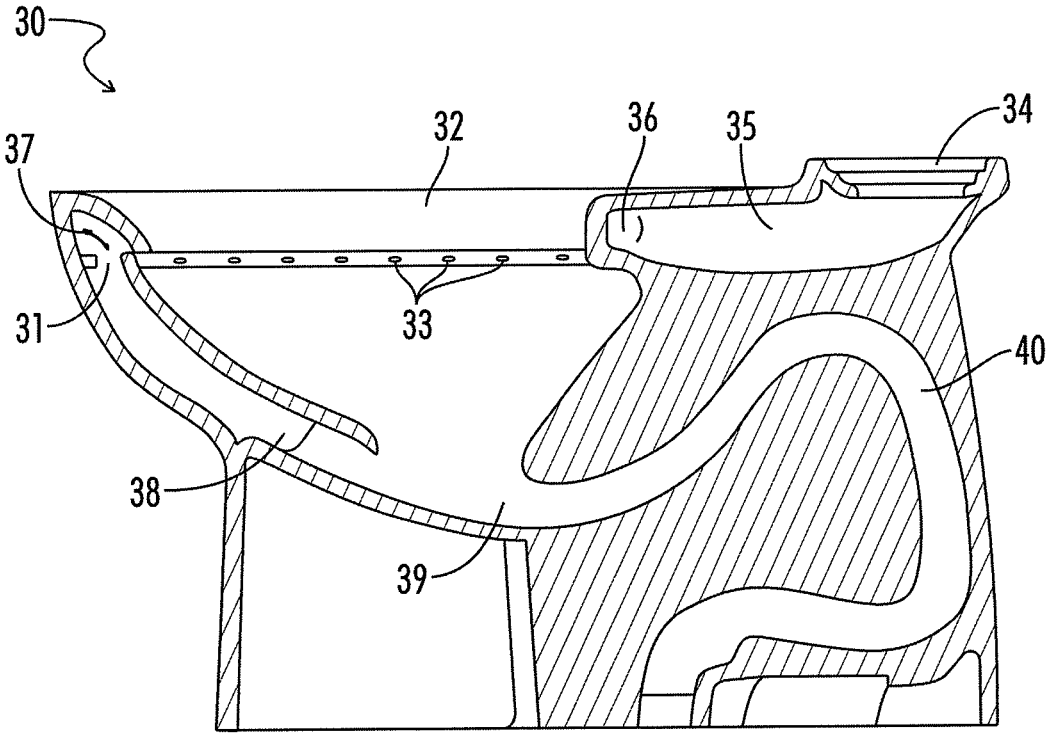
FIG. 2 is a longitudinal cross-sectional view of a rim fed jet toilet according to one embodiment of the invention herein.

In the rim fed jet toilet, depicted as 30 in FIG. 2, flush water passes from a water tank to the bowl through the bowl inlet port 34 and into the primary manifold 35. At the end of the primary manifold, the water passes through the rim inlet port 36 and flows symmetrically around both sides of the rim channel 32. A portion of the water flows through the rim outlet ports 33 as the water travels through the rim channel, which serves to cleanse the bowl during the flush cycle. At the front of the rim channel, the remaining portion of the water enters the jet channel 31 through the jet inlet port 37. The water in the jet channel 31 flows to the jet outlet port 38 and directs a strong, pressurized stream of water at the trapway opening 39. This strong pressurized stream of water is capable of rapidly initiating a siphon in the trapway 40 to evacuate the bowl and its contents to the sewer line. The water that flows through the rim channel 32 also causes a strong pressurized stream of water to exit rim holes and cleanse the bowl as well as contributing to the siphon.

To function as a siphonic dual flush toilet, there are several key relationships that must be maintained in the geometrical features of a rim fed jet toilet. Maintaining these relationships within the following limits makes it possible to produce a toilet that can achieve a peak flow rate of >2500 ml/s while reaching a flow rate greater than about 2000 ml/s in less than less 1.75 seconds into the flush cycle. These geometrical relationships are:

$$A_{pm}>35\ \text{cm}^2>A_{jip}>A_{jop}>6.4\ \text{cm}^2>A_{rop} \quad \text{(V)}$$

where $A_{pm}$ is the transverse cross-sectional area of the primary manifold, $A_{jip}$ is the transverse cross-sectional area of the jet inlet port, $A_{jop}$ is the transverse cross-sectional area of the jet outlet port, and $A_{rop}$ is the transverse cross-sectional area of the rim outlet port(s). Holding the size of the internal water chambers within these limits creates a system with optimal flow characteristics.

When the cross-sectional area of the primary manifold is below about 35 $cm^2$, the flow of water exiting the tank is constricted, which will prevent the system from achieving the rapid and strong siphon necessary for a toilet to function adequately as a siphonic dual flush. Similarly, when the area of the jet outlet port is less than about 6.4 $cm^2$ or other relationships in equation (V) are not maintained, the flow of water is constricted and a rapid formation of a powerful siphon cannot be obtained. As with the direct fed jet system, there is also an upper limit on the size of these ports and channels, above which the sheer volume of water necessary to fill them sufficiently to transfer pressure and energy to the trapway becomes infeasible on six or fewer liters of water. Due to aesthetic and manufacturing constraints, however, this limit is less likely to become an issue than constriction due to insufficient size of channels and ports.

In addition to these critical relationships within the water delivery channels, the geometry of the trapway in a rim-fed jet or a direct fed jet toilet is also critical. The trapway should have a volume of less than 2500 ml, and preferably less than 2000 ml. Limiting the trapway volume is critical for the toilet's capability to siphon at a partial flush volume of <4.5 liters per flush. Furthermore, the trapway should be free of constrictions, able to pass a sphere of diameter >1.75 inches through its entire length. Outside of these restrictions, the trapway can take many different three-dimensional forms, such as the smooth sideways u-shaped pattern shown in FIGS. 1, 4 and 5. It is also sometimes desirable to use a trapway with additional bends and kinks to retard the flow of water and facilitate the formation of a powerful siphon.

Figure 4:
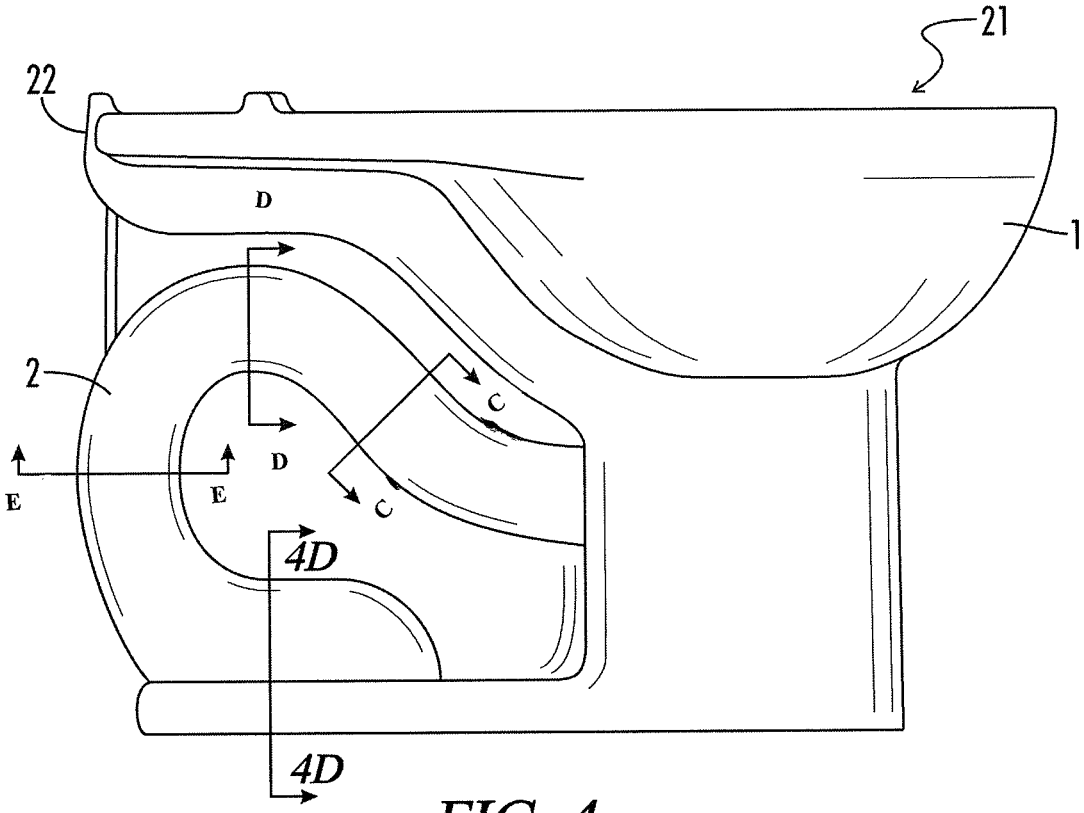
FIG. 4 is a side elevational view of a toilet bowl according to the embodiment of FIG. 1 of the invention herein showing an outside view of a representative trapway according to the invention.
Figure 4A:
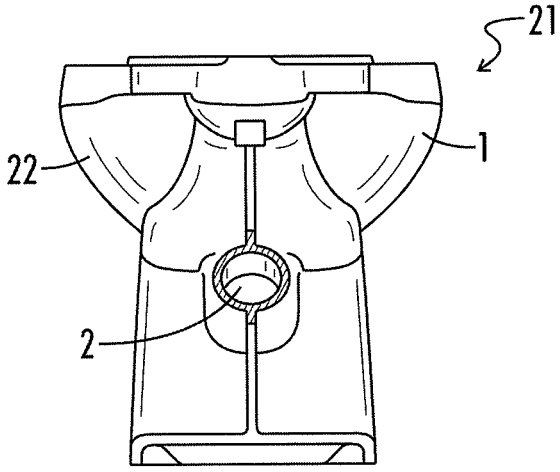
FIGS. 4A-4D are partial transverse cross-sectional views of the trapway of the toilet bowl of FIG. 5 taken along lines C-C, D-D, E-E and F-F, respectively.
Figure 4C:
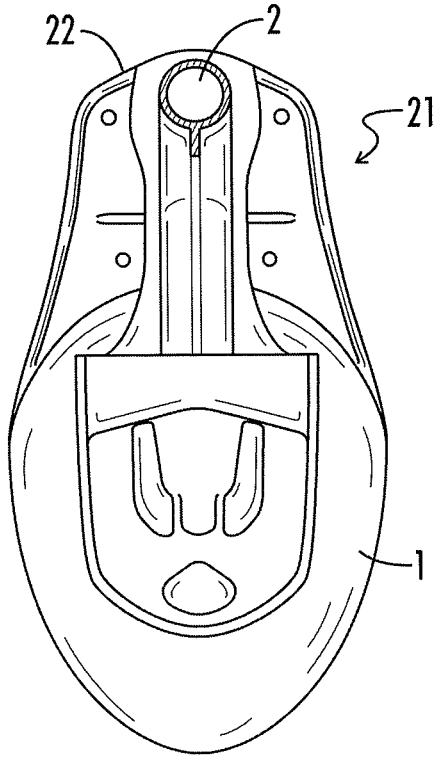
Figure 4B:
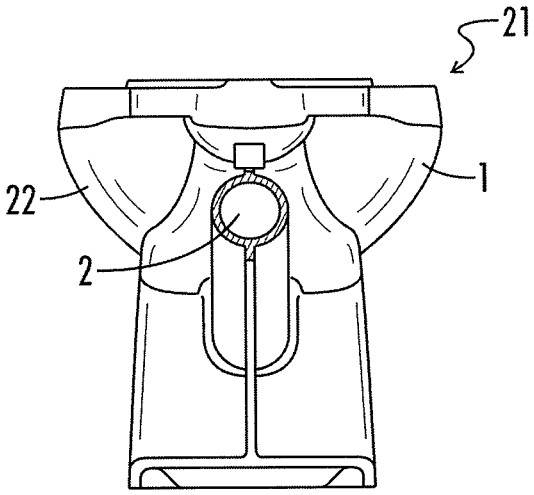
Figure 4D:
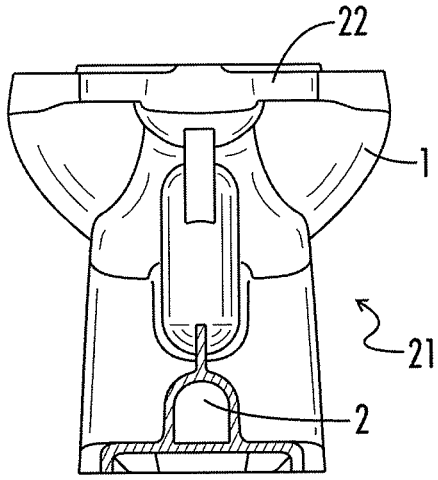
Figure 5:
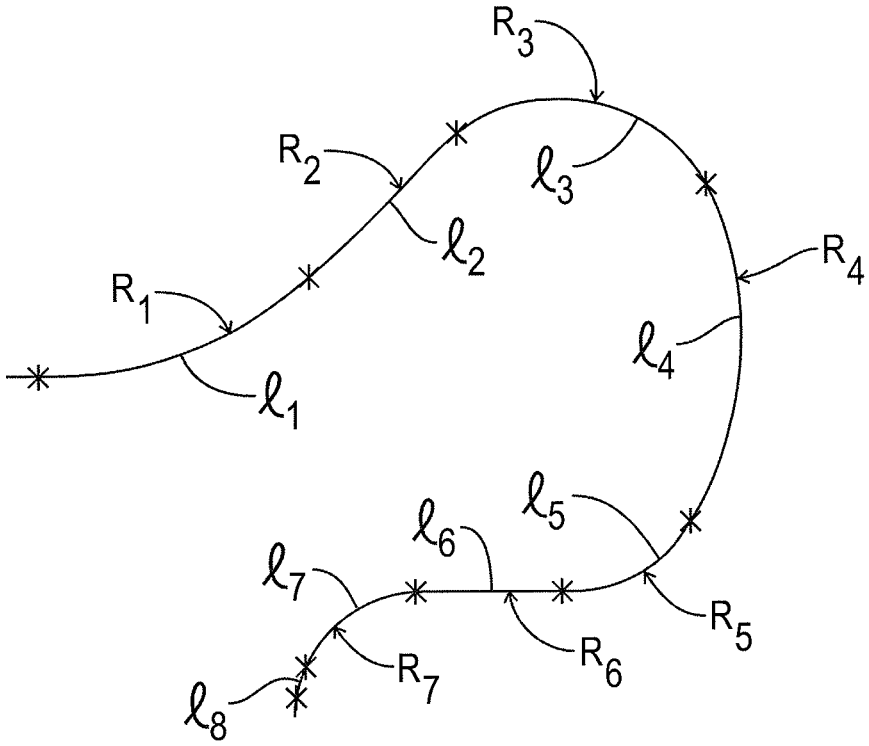
FIG. 5 is a line curve representing a shape useful in an embodiment of a trapway for a toilet as disclosed herein.

In one embodiment of the invention illustrated in FIGS. 1, 4 and 5, the trapway is generally circular in transverse cross-section with a diameter of about 47 mm to about 54 mm. With reference to FIGS. 1 and 5, the trapway joins the bowl at the rear of the sump 5 and flows in an upward direction following a path along $l_1$ that can be described as an arc of variable radius R1 of about 114 mm to about 190 mm, preferably about 152 mm, for a length along $l_1$ about 87 mm to about 145 mm, preferably about 116 mm. The radius of the arc changes along a next length $l_2$ (that length ranging from about 58 mm to about 97 mm, preferably about 78 mm) to a radius $R_2$ from about 381 mm to about 635 mm, preferably about 508 mm. It then along length $l_3$ makes a transition to an arc with an opposing radius $R_3$ of about 65 mm to about 75 mm preferably 70 mm, wherein length $l_3$ is from about 129 mm to about 150 mm, preferably about 139 mm, wherein the apex of radius $R_3$ on length $l_3$ forms the weir of the toilet.

The trapway then makes a transition to a down leg section over $l_4$ of length between about 133 mm to about 185 mm, preferably about 145 mm. This downward section can be described as an arc of radius $R_4$ between about 0 mm to about 284 mm, preferably about 142 mm.

After tracing this downward arc, the trapway turns to flow towards the front of the bowl. Here in this bottom-most section, it diverges from being circular in cross-section, with the bottom wall following a different path than the top so that the bottom wall typically has less curvature. Over length $l_5$, as the trapway bends backwards, over a length of about 48 mm to about 55 mm, preferably about 52 mm, the radius $R_5$ through the center of the trapway curves backwards toward the front of the bowl at a radius of about 50 mm to about 58 mm, preferably about 54 mm. It then travels a length $l_6$ of 58 mm to about 80 mm, preferably about 64 mm at relatively low radius $R_6$ of about 0 radius (essentially generally straight). Finally, the trapway turns down again at a radius $R_7$ of from about 41 mm to about 69 mm, preferably about 55 mm, to form the outlet that is coupled to the sewage line over length 17 of about 59 mm to about 104 mm. The outlet can descend at 0 radius for a length of about 7 mm to about 9 mm, preferably about 8 mm. The various angles and cross-sectional areas can be seen best in the cross-sectional views shown in FIG. 5. FIG. 4 shows a side view of a representative toilet as in FIG. 1, having various cross-sectional views of the trapway designated and shown as an example in FIGS. 4A-4D.

In alternative embodiments, this down leg can be an arc of increasing radius, becoming nearly linear as it descends (similar to that pictured in FIG. 2). Or it can be linear extending directly from the arc that forms the weir, becoming nearly linear with increasing length down the leg. Alternative designs may also include the leg generally linear but angled backward toward the back of the toilet. Further other design configurations made to include turbulence-generating ledges or bumps, dual weirs and other trapway configurations may be used as well within the invention. The trapway may vary and should not be considered limiting to the invention herein, provided however, that it is not preferred to use a trapway which would significantly negatively impact the performance benefits of the invention as described elsewhere herein.

Finally, the tank must be fitted with specialized valves to enable these toilets to function properly as a siphonic dual flush. FIGS. 3 and 4 are a cross-sectional and top view, respectively, of a tank 14 useful for the toilet system herein. Tank 14 contains a commercially available fill valve 15 and a commercially available dual flush valve 16. The dual flush valve has two top-mounted buttons for flush activation: a full-flush button 18 and a partial flush button 17. Refill water can exit the fill valve 15 through the refill tube 19 and into the overflow tube 20 on the dual flush valve 16. The overflow tube 20 is in liquid communication and otherwise connected to tank inlet port 9 so as to allow refill water to flow into the bowl 4 through the manifold 10 and to the jet opening 6 and through rim channel 3*a* to rim holes 8. The full-flush button 18 and the partial-flush button 17 may be further activated by means of mechanisms known in the art that can be located on the outside of the tank, for example, external dual-flush buttons mounted in the tank lid (not shown) and other similar mechanisms as are known or to be developed in the art.

Another key feature necessary to achieve the aforementioned advantages and provide a siphonic toilet system capable of operating under dual- or multi-flush cycles lies in optimal selection of the refill ratio. In one embodiment of the invention, the refill ratio is set such that it returns the water level in the bowl to a full seal depth when the shortest flush cycle is activated. This results in greater than the required refill volume being directed to the bowl after longer flush cycles. But the overall flush volume of the longer cycles can still be maintained at the desired level by selection of the appropriate main flush volume from the tank. This embodiment will be further explained through the subsequent examples.

In a further embodiment herein, the invention preferably uses a specialized fill valve that enables selection of a refill ratio that is dependant upon the flush cycle chosen. An example of such a refill valve is described in U.S. Pat. No. 5,647,068, incorporated herein in relevant part by reference. When a partial flush is chosen, a higher refill ratio is directed to the bowl than when a full flush cycle is chosen. In this way, the optimal amount of refill water is directed to the bowl to replenish the seal depth and deliver true siphonic toilet performance. The variable refill ratio may be accomplished by simple mechanical mechanisms involving floats, water pressure, or air pressure. Or the ratio variability may be accomplished through an electronic mechanism including actuators or other electromechanical devices.

The invention will now be further explained with reference to the following non-limiting examples. Data from each of the Examples is summarized in Table 1. In the Examples, various parameters are measured in terms of a peak flow curve. This is generated through testing in which a toilet bowl was set on a flush stand. The bowl was set to the desired water consumption and water pressure. A Toledo Speedweight scale was placed under the bowl. A bucket was placed on the scale. The distance form the bowl outlet to the standard bucket (having 12 inch diameter) was set to 17 inches. The scale logged data at a rate of 25 data points per second.

The Toledo scale was connected to a data logging system. The bowl was flushed to gather the data. A curve smoothing process was used with seven data points per second. A flow curve was generated from the first derivative of the data against time in the flush cycle. From the flow curve data, a peak flow was determined as being the highest value. The time to peak rate was measured from the first data point to where the peak value was achieved in the flow curve data. To measure trap volume, the bowl to be measured was secured in a vertical configuration. The trapway outlet was plugged. A measured amount of water was poured into the trap from the trap inlet, and the outlet plug cracked to purge air. Water continued to be filled from the trap inlet until it was full. The inlet port area was measured by using a diamond saw and cutting the china bowl at the correct port opening. The inlet port was traced on engineering graph paper, and the area measured from the graph paper template.

Comparative Example 1

A commercially available wash-down dual flush toilet (American Standard, Flowise Dual Flush) was chosen for a comparative example in a study as an exemplary depiction of the prior art.

The toilet had two flush cycles, a full flush stated by the manufacturer as 6.0 liters per flush and a partial flush stated as 3.0 liters per flush. After activating the full flush, 5547 ml of water were found to have exited the outlet of the bowl. The fill valve was determined to be factory set to a refill ratio of 0% so that during the refill cycle, it directed 5547 ml of water to refilling the tank and 0 ml of water to filing the bowl. At the completion of the full flush cycle, the surface area of the water in the bowl was measured as 115 $cm^2$, the volume of water in the bowl was 1500 ml, and the seal depth was 5.4 cm.

The flow rate of water out of the outlet of the toilet was measured by placing a collection reservoir on a digital scale connected to a data collection system. The peak discharge rate during the fall, 6-liter cycle was measured at 1839 ml/s, which is in the typical range for wash down toilets. Siphonic toilets generate higher peak discharge rates, almost always being greater than 2000 ml/s.

After completion of the full flush, a partial flush cycle was initiated. At the completion of the partial flush cycle, the surface area of the water in the bowl was 115 $cm^2$ and the seal depth was 5.4 cm. The flow rate of water out of the outlet of the toilet was measured by placing a collection reservoir on a digital scale connected to a data collection system. The peak discharge rate during the 0.8 liter partial flush cycle was measured at 983 ml/s, again in the typical range for wash down toilets.

Although this toilet functioned adequately in terms of bulk removal, the small surface area of water, less than 200 $cm^2$ would contribute to cleanliness problems and lack of odor suppression common to wash-down toilets.

Comparative Example 2

A commercially available dual flush toilet (Sterling) marketed as a "siphonic wash down" was chosen as a further comparative example for testing and comparison with the present invention.

The toilet had two flush cycles, a full flush stated by the manufacturer as 6.0 liters per flush and a partial flush stated as 3.0 liters per flush. After activating the full flush, 5819 ml of water were found to have exited the outlet of the bowl. The fill valve was determined to be factory set to a refill ratio of 12% so that during the refill cycle, it directed 5187 ml of water to refilling the tank and 707 ml of water to filling the bowl, 75 ml of the 707 ml directed to the bowl were in excess of the amount required and spilled over the weir, which yields a total flush volume of 5894 ml. At the completion of the full flush cycle and refill, the surface area of the water in the bowl was 131 $cm^2$, and the seal depth was measured as 6.4 cm. The flow rate of water out of the outlet of the toilet was measured by placing a collection reservoir on a digital scale connected to a data collection system. The peak discharge rate during the full, 6-liter flush was measured at 2994 ml/s, which is well within the typical range for siphonic toilets.

After completion of the full flush, a partial flush cycle was initiated. At the completion of the partial flush cycle and refill of the bowl and tank with the same 12% refill ratio, the surface area of the water in the bowl was reduced to 104 $cm^2$, and the seal depth was reduced to 5.1 cm. This reduced volume of water demonstrates the inadequate selection of refill ratio for this system. However, the applicants herein noted that changing the refill ratio in itself would not have improved the system, as it would have resulted in the full flush exceeding 6.0 liters per flush. The flow rate of water out of the outlet of the toilet was measured by placing a collection reservoir on a digital scale connected to a data collection system. The peak discharge rate was reduced to 2150 ml/s during the partial flush, which is low in the range for siphonic toilets. When the partial flush was repeated, it failed to siphon on the second cycle due to the diminished level of water in the bowl.

Although this toilet functioned adequately in terms of bulk removal, its small water spot would cause cleanliness problems and lack of odor suppression common to wash down toilets. It was also not truly siphonic as demonstrated by the failure to siphon after repeated activation of the partial flush.

Comparative Example 3

A commercially available wash down dual flush toilet (Toto Aquia III) was chosen as a further comparative example for testing and comparison with the present invention. The bowl is not formed with a siphon jet. All of the flush water flows from the rim of the toilet.

The toilet has two flush cycles, a full flush stated by the manufacturer as 6.0 liters per flush and a partial flush stated as 3.4 liters per flush. After activating the full flush, 5289 ml of water were found to have exited the outlet of the bowl. The fill valve was determined to be factory set to a refill ratio of 5.5% so that during the refill cycle, it directed 5266 ml of water to refilling the tank and 307 ml of water to filling the bowl, 284 ml of the 307 ml directed to the bowl were in excess of the amount required and spilled over the weir, which yields a total flush volume of 5573 ml. At the completion of the full flush cycle and refill, the surface area of the water in the bowl was 118 $cm^2$ and the seal depth was measured as 5.7 cm. The flow rate of water out of the outlet of the toilet was measured by placing a collection reservoir on a digital scale connected to a data collection system. The peak discharge rate was measured at 1491 ml/s, which is in the typical range for wash down toilets.

After completion of the full flush, a partial flush cycle was initiated. At the completion of the partial flush cycle and refill of the tank, the surface area of the water in the bowl was 118 $cm^2$ and the seal depth returned to 5.7 cm. The flow rate of water out of the outlet of the toilet was measured by placing a collection reservoir on a digital scale connected to a data collection system. The peak discharge rate was measured at 1219 ml/s which is typical for wash down toilets.

Although this toilet functioned adequately in terms of bulk removal, its small water results in excessive soiling of the bowl during use and provides minimal odor suppression. The very small water spot of 118 $cm^2$ would make such issues especially noticeable.

Comparative Example 4

A commercially available dual flush toilet (Milim Water Ridge Model No. 386082) was chosen as a further comparative example for testing and comparison with the present invention. The bowl is formed with a direct-fed siphon jet with port dimensions and hydraulic performance as provided in Table 1. Several of the port dimensions are within the inventive guidelines of equations (III) and (IV) above. However, the transverse cross-sectional area of the primary manifold is below 35 $cm^2$ (which the inventors have found to be significant for adequate hydraulic performance). The resulting constriction of the flow reveals itself through weak and sluggish hydraulic function, requiring 2.0 s of the flush cycle to reach a flow rate of >2000 ml/s. This weakness and sluggishness negatively impacts the true siphonic nature of the system as will become evident below.

The toilet is equipped to function at two flush cycles, a full flush stated by the manufacturer as 6.0 liters per flush and a partial flush stated as 4.1 liters per flush. After activating the full flush, 5315 ml of water were found to have exited the outlet of the bowl. The fill valve was determined to be factory set to a refill ratio of 30% so that during the refill cycle, it directed 4039 ml of water to refilling the tank and 1731 ml of water to filling the bowl, 455 ml of the 1731 ml directed to the bowl were in excess of the amount required and spilled over the weir, which yields a total flush volume of 5770 ml. At the completion of the full flush cycle and refill, the surface area of the water in the bowl was 528 $cm^2$ and the seal depth was measured as 5.7 cm. As mentioned above, the peak flow rate of water out of the outlet of the toilet was measured by placing a collection reservoir on a digital scale connected to a data collection system. The peak discharge rate was measured at 2558 ml/s, which is in the typical range for siphonic toilets. However, the flow required 2.0 s to exceed 2000 ml/s, indicative of sluggish and weak hydraulic performance.

After completion of the full flush, a partial flush cycle was initiated. At the completion of the partial flush cycle and refill of the tank and bowl with the same 30% refill ratio, the surface area of the water in the bowl was reduced to 436 $cm^2$ and the seal depth had reduced to 5.2. Thus, this toilet is not functioning as a truly siphonic dual flush. The sluggish hydraulic performance and non-optimal refill ratio provide an unstable system that cannot maintain water content in the bowl with variation in flush volume. Furthermore, additional consecutive flush cycles at the partial flush volume can exacerbate this issue, reducing the seal depth and size of the water spot even further. Increasing the refill ratio could be a route to correct the issue, but this would lead to excess water usage on the full flush volume, sending it over the 6.0-liter limit required by the majority of plumbing codes. The inventors have found that the sluggish hydraulic performance can be correlated to constriction of flow in the primary manifold failure to maintain the geometric relationships of port sizes in equations (III) and (IV).

Comparative Example 5

A commercially available dual flush toilet (Briggs Conserver Dual Flush) was chosen as a further comparative example for testing and comparison with the present invention. The bowl is formed with a direct-fed siphon jet, but the construction is not in line with the desirable arrangement of channels and ports described above and pictured in FIG. 1. The primary manifold is divided into upper and lower sections immediately downstream from the bowl inlet port to form what can be described as a rim manifold (the upper passage) and a jet manifold (the lower passage). Hence, the guidelines of equations (III) and (IV) above cannot be rigorously applied to this toilet. This non-optimal construction results in weak and sluggish hydraulic performance, requiring 1.8 s to reach a flow rate of >2000 ml/s. This weakness and sluggishness negatively impacts the true siphonic nature of the system as will become evident below.

The toilet is equipped to function at two flush cycles, a full flush stated by the manufacturer as 6.0 liters per flush and a partial flush stated as 3.75 liters per flush. After activating the full flush, 5150 ml of water were found to have exited the outlet of the bowl. The fill valve was determined to be factory set to a refill ratio of 15.25% so that during the refill cycle, it directed 4736 ml of water to refilling the tank and 852 ml of water to filling the bowl, 438 ml of the 852 ml directed to the bowl were in excess of the amount required and spilled over the weir, which yields a total flush volume of 5588 ml. At the completion of the full flush cycle and refill, the surface area of the water in the bowl was 349 $cm^2$ and the seal depth was measured as 5.7 cm. As mentioned above, the peak flow rate of water out of the outlet of the toilet was measured by placing a collection reservoir on a digital scale connected to a data collection system. The peak discharge rate was measured at 2662 ml/s, which is in the typical range for siphonic toilets. However, the flow rate required 1.8 seconds to exceed 2000 ml/s, indicating sluggish and weak hydraulic performance.

After completion of the full flush, a partial flush cycle was initiated. At the completion of the partial flush cycle and refill of the tank and bowl with the same 15.25% refill ratio, the surface area of the water in the bowl was reduced to 311 $cm^2$ and the seal depth had reduced to 5.1 cm. Thus, this toilet is not functioning as a truly siphonic dual flush. The sluggish hydraulic performance and non-optimal refill ratio provide an unstable system that cannot maintain water content in the bowl with variation in flush volume. Furthermore, additional consecutive flush cycles at the partial flush volume exacerbate the issue, reducing the seal depth and size of the water spot even further. Increasing the refill ratio could be a route to correct the issue, but this would lead to excess water usage on the full flush volume, sending it over the 6.0-liter limit required by the majority of plumbing codes. The inventors have found that the sluggish hydraulic performance can be related back to constriction of flow due to the lack of a true primary manifold and failure to maintain the geometric relationships of port sizes in equations (III) and (IV).

Example 6

A 16.5" height toilet bowl with an elongated front rim as depicted in FIG. 1 was coupled to a tank as depicted in FIG. 3 in accordance with the present invention. The tank was fitted with a commercially available dual flush valve and a commercially available fill valve with a refill ratio of 18%. The toilet has two flush cycles, a full flush targeted to deliver 6.0 liters per flush and a partial flush targeted to deliver 3.7 liters per flush. The geometric relationships of port sizes in the toilet are provided in Table 1. All are within the guidelines of equations (III) and (IV).

After activating the full flush, 4949 m. of water were found to have exited the outlet of the bowl. The fill valve was determined to be factory set to a refill ratio of 18% so that during the refill cycle, it directed 4879 ml of water to refilling the tank and 1071 ml of water to refilling the bowl, 1001 ml of the 1071 ml directed to the bowl were in excess of the amount required and spilled over into the weir, which yields a total flush volume of 5950 m. At the completion of the full flush cycle and refill, the surface area of the water in the bowl was 386 $cm^2$, and the seal depth was 5.7. The flow rate of water out of the outlet of the toilet was measured by placing a collection reservoir on a digital scale connected to a data collection system. The peak discharge rate was measured at 3410 ml/s, which is indicative of extremely strong siphonic performance.

After completion of the full flush, a partial flush cycle was initiated. After activating the partial flush, 3801 ml of water were found to exit the outlet of the bowl. Being a siphonic toilet, the fill valve directed 3124 ml of water to refilling the tank and 686 ml of water to filling the bowl, which corresponds to a refill ratio of 18%. The total flush volume was 3810 ml. At the completion of the partial flush cycle and refill of the bowl and tank with the same 18% refill ratio, the surface area of the water in the bowl was 386 $cm^2$, and the seal depth returned to 5.7 cm. This consistent volume of water demonstrates the greatly enhanced performance and utility of the present invention. The flow rate of water out the outlet of the toilet was measured by placing a collection reservoir on a digital scale connected to a data collection system. The peak discharge rate was measured at 3225 ml/s and the flow rate exceeded 2000 ml/s after only 1.1 s into the flush cycle, which is again indicative of very strong siphonic performance.

As can be seen through this example, the toilet system of this embodiment of the invention enables truly siphonic dual flush performance and was capable of providing bowl cleanliness and a high rate of discharge without sacrificing seal depth, volume of water in the bowl, and/or size of water spot. The toilet functions and delivers features available in common 6.0 liter per flush siphonic toilets with the added advantage of offering the option for water saving flush cycle.

Example 7

A normal height (15") toilet bowl with a round front rim similar to the elongated rim bowl shown in FIG. 1 was coupled to a tank as depicted in FIG. 3 in accordance with an embodiment of the invention herein. The tank was fitted with a commercially available dual flush valve and a commercially available fill valve with a refill ratio of 18%. The toilet has two flush cycles, a full flush targeted to deliver 6.0 liters per flush and a partial flush targeted to deliver 3.7 liters per flush. The geometric relationships of port sizes in the toilet are provided in Table 1. All are within the guidelines of equations (III) and (IV).

The tank was fitted with a commercially available dual flush valve and a commercially available fill valve with a refill ratio of 18%. The toilet had two flush cycles, a full flush targeted to deliver 6.0 liters per flush and a partial flush targeted to deliver 3.7 liters per flush. After activating the full flush, 4949 ml of water were found to have exited the outlet of the bowl. The fill valve was determined to be factory set to a refill ratio of 18% so that during the refill cycle, it directed 4498 ml of water to refilling the tank and 987 ml of water to filling the bowl, 536 ml of the 987 ml directed to the bowl were in excess of the amount required and spilled over the weir, which yields a total flush volume of 5485 ml. At the completion of the full flush cycle and refill, the surface area of the water in the bowl was 386 $cm^2$, and the seal depth was measured as 5.7 cm. The flow rate of water out of the outlet of the toilet was measured by placing a collection reservoir on a digital scale connected to a data collection system. The peak discharge rate was measured at 3314 ml/s, which is in the typical to high range for siphonic toilets.

After completion of the full flush, a partial flush cycle was initiated. After activating the partial flush, 3155 ml of water were found to have exited the tank and 3801 ml of water were found to have exited the outlet of the bowl. The total flush volume was 3847 ml. Being a siphonic toilet, the fill valve directed 3155 ml of water to refilling the tank and 692 ml of water to filling the bowl, which corresponds to a refill ratio of 18%. At the completion of the partial flush cycle and refill of the bowl and tank with the same 18% refill ratio, the surface area of the water in the bowl was 386 $cm^2$, and the seal depth returned to 5.7 cm. This consistent volume of water demonstrated the greatly enhanced performance and utility of this embodiment of the present invention.

The flow rate of water out the outlet of the toilet was measured by placing a collection reservoir on a digital scale connected to a data collection system. The peak discharge rate was measured at 3110 ml/s during the partial flush, which is in the typical range for siphonic toilets. The flow rate exceeded 2000 ml/s after only 1.0 s in the flush cycle.

As can be seen through this example, this toilet system according to an embodiment of the invention enabled truly siphonic dual flush performance as defined by bowl cleanliness and high rate of discharge without sacrificing seal depth, volume of water in the bowl, and/or size of water spot. The toilet functioned and delivered features available in common 6.0 liter per flush siphonic toilets with the added advantage of offering the option for water saving flush cycle.

Example 8

The 15" height toilet bowl with a round front rim from Example 4 was coupled to a tank that was fitted with a commercially available dual flush valve and a specially modified fill valve capable of providing a variable refill ratio in accordance with U.S. Pat. No. 5,647,068. The toilet had two flush cycles, a full flush targeted to deliver 6.0 liters per flush and a partial flush targeted to deliver 3.7 liters per flush. Again all of the port geometries were within the relationships described in equations (III) and (IV).

After activating the full flush, 5362 ml of water were found to have exited the outlet of the bowl. The fill valve was determined to be factory set to a refill ratio of 8% so that during the refill cycle, it directed 5336 ml of water to refilling the tank and 464 ml of water to filling the bowl, 438 ml of the 464 ml directed to the bowl were in excess of the amount required and spilled over the weir, which yields a total flush volume of 5800 ml. At the completion of the full flush cycle and refill, the surface area of the water in the bowl was 386 $cm^2$, and the seal depth returned to 5.7 cm. The flow rate of water out the outlet of the toilet was measured by placing a collection reservoir on a digital scale connected to a data collection system. The peak discharge rate was measured at 3300 ml/s and a flow rate of greater than 2000 ml/s was achieved in 1.0 s, both factors being indicative of extremely strong siphonic performance.

After completion of the full flush, a partial flush cycle was initiated. After activating the partial flush, 3847 ml of water were found to have exited the outlet of the bowl. The fill valve was determined to be factory set to a refill ratio of 18% so that during the refill cycle, it directed 3161 ml of water to refilling the tank and 694 ml of water to filling the bowl, 8 ml of the 694 ml directed to the bowl were in excess of the amount required and spilled over the weir, which yields a total flush volume of 3855 ml. At the completion of the partial flush cycle and refill of the bowl and tank with the same 18% refill ratio, the surface area of the water in the bowl was 386 $cm^2$, and the seal depth returned to 5.7 cm. This consistent volume of water demonstrates the greatly enhanced performance and utility of this embodiment of the present invention. The flow rate of water out the outlet of the toilet was measured by placing a collection reservoir on a digital scale connected to a data collection system. The peak discharge rate was measured at 3110 ml/s and a flow rate of greater than 2000 ml/s was achieved in 1.0 s, again indicative of extremely strong hydraulic performance.

As can be seen through this example, this toilet system according to an embodiment of the invention enabled truly siphonic dual flush performance as defined by bowl cleanliness and high rate of discharge without sacrificing seal depth, volume of water in the bowl, and/or size of water spot. The toilet functioned and delivered features available in common 6.0 liter per flush siphonic toilets with the added advantage of offering the option for water saving flush cycle. Assuming the two partial flush to one full flush usage pattern discussed above, this toilet provides an average water usage of 4.06 liters per flush, a 32% reduction over the 6.0 liter per flush standard.

TABLE 1

| | | Cross-Sect'l Area Primary Mani-fold ($cm^2$) | Jet Inlet Port Area ($cm^2$) | Rim Inlet Port Area ($cm^2$) | Total inlet ports | Jet Outlet Port Area ($cm^2$) | Rim Outlet Port Area ($cm^2$) | Total outlet ports ($cm^2$) | Sump Vol. (ml) | Min. Trap Diameter (cm) | Trap Vol. (ml) | Total flush Vol. (ml) | Main flush Vol. (ml) |
|---|---|---|---|---|---|---|---|---|---|---|---|---|---|
| Full | Ex 1 | A | a | a | a | a | A | a | 1500 | 5.7 | 5200 | 5547 | 5547 |
| Flush | Ex 2 | A | a | a | a | a | A | a | 1400 | 4.4 | 1750 | 5894 | 5819 |
| Cycle | Ex 3 | A | a | a | a | a | A | a | 1350 | 5.4 | 1950 | 5573 | 5289 |
| | Ex 4 | 33.1 | 28.5 | 10.3 | 38.8 | 7.9 | 4.5 | 12.4 | 2500 | 4.8 | 1875 | 5770 | 5315 |
| | Ex 5 | B | b | b | b | b | B | b | 1750 | 4.9 | 1800 | 5588 | 5150 |
| | Ex 6 | 40.8 | 31.7 | 19.1 | 50.8 | 8.0 | 3.2 | 11.2 | 2350 | 4.9 | 1850 | 5950 | 4949 |
| | Ex 7 | 40.8 | 31.7 | 19.1 | 50.8 | 8.0 | 3.2 | 11.2 | 2350 | 4.9 | 1700 | 5485 | 4949 |
| | Ex 8 | 40.8 | 31.7 | 19.1 | 50.8 | 8.0 | 3.2 | 11.2 | 2400 | 4.9 | 1700 | 5800 | 5362 |
| Partial | Ex 1 | a | a | a | a | a | a | a | 1500 | 5.7 | 5200 | 2687 | 2687 |
| Flush | Ex 2 | a | a | a | a | a | a | a | 1400 | 4.4 | 1750 | 3217 | 3217 |
| Cycle | Ex 3 | a | a | a | a | a | a | a | 1350 | 5.4 | 1950 | 3257 | 3017 |
| | Ex 4 | 33.1 | 28.5 | 10.3 | 38.8 | 7.9 | 4.5 | 12.4 | 2500 | 4.8 | 1875 | 4003 | 4003 |
| | Ex 5 | b | b | b | b | b | b | b | 1750 | 4.9 | 1800 | 4187 | 4187 |
| | Ex 6 | 40.8 | 31.7 | 19.1 | 50.8 | 8.0 | 3.2 | 11.2 | 2350 | 4.9 | 1850 | 3810 | 3801 |
| | Ex 7 | 40.8 | 31.7 | 19.1 | 50.8 | 8.0 | 3.2 | 11.2 | 2350 | 4.9 | 1700 | 3847 | 3801 |
| | Ex 8 | 40.8 | 31.7 | 19.1 | 50.8 | 8.0 | 3.2 | 11.2 | 2400 | 4.9 | 1700 | 3847 | 3855 |

| | | Peak Flush Discharge Rate (ml/s) | Time to reach 2000 ml/s (s) | Time to reach 2500 ml/s (s) | Refill Ratio | Water spot length (cm) | Water spot width (cm) | Water spot area ($cm^2$) | Seal depth (cm) |
|---|---|---|---|---|---|---|---|---|---|
| Full | Ex 1 | 1839 | c | C | 0.0% | 14.0 | 10.5 | 115 | 5.4 |
| Flush | Ex 2 | 2994 | 1.5 | 1.7 | 12.0% | 14.6 | 11.4 | 131 | 6.4 |
| Cycle | Ex 3 | 1491 | c | C | 5.5% | 14.0 | 10.8 | 118 | 5.7 |
| | Ex 4 | 2558 | 2.0 | 2.5 | 30.0% | 29.8 | 22.5 | 528 | 5.7 |
| | Ex 5 | 2662 | 1.8 | 2.1 | 15.3% | 24.1 | 18.4 | 349 | 5.7 |
| | Ex 6 | 3410 | 1.1 | 1.2 | 18.0% | 22.9 | 21.0 | 386 | 5.7 |
| | Ex 7 | 3314 | 1.0 | 1.1 | 18.0% | 22.9 | 21.0 | 386 | 5.7 |
| | Ex 8 | 3300 | 1.0 | 1.1 | 8.0% | 22.9 | 21.0 | 386 | 5.7 |
| Partial | Ex 1 | 983 | c | C | 0.0% | 14.0 | 10.5 | 115 | 5.4 |
| Flush | Ex 2 | 2150 | 1.7 | C | 12.0% | 13.0 | 10.2 | 104 | 5.1 |
| Cycle | Ex 3 | 1219 | c | C | 5.5% | 14.0 | 10.8 | 118 | 5.7 |
| | Ex 4 | 2186 | 2.4 | C | 30.0% | 27.3 | 20.3 | 436 | 5.2 |
| | Ex 5 | 2372 | 2.2 | C | 15.3% | 21.9 | 18.1 | 311 | 5.1 |
| | Ex 6 | 3225 | 1.1 | 1.2 | 18.0% | 22.9 | 21.0 | 386 | 5.7 |
| | Ex 7 | 3110 | 1.0 | 1.5 | 18.0% | 22.9 | 21.0 | 386 | 5.7 |
| | Ex 8 | 3110 | 1.0 | 1.15 | 18.0% | 22.9 | 21.0 | 386 | 5.7 |

a. Toilet is not formed with siphon jet. Port sizes and relationships are nonexistent or irrelevant.
b. Toilet is jetted but does not have a true primary manifold. Port sizes and relationships are nonexistent or irrelevant.
c. Specified flow rate is not achieved during the flush cycle.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A gravity flush, direct fed jet toilet system having at least two flush volumes, comprising a toilet bowl having an outlet and a tank, wherein the tank comprises at least one fill valve and at least one flush valve, the system provides a surface area of water in the toilet bowl of at least about 200 $cm^2$ and a peak flow rate measured at an outlet of the bowl during a siphon of at least about 2500 ml/s and a flow rate of at least 2000 ml/s is achieved in no greater than about 1.75 seconds from initiation of a flush cycle, wherein internal cross-sectional area measurements within the toilet system are defined by the following relationships:

$$A_{pm}>35\ cm^2>A_{jip}>A_{jop}>6.4\ cm^2 \quad (III)$$

$$A_{pm}>35\ cm^2>A_{rip}>A_{jop}>6.4\ cm^2>A_{rop} \quad (IV)$$

wherein $A_{pm}$ is a cross-sectional area of a primary manifold, $A_{jip}$ is a cross-sectional area of a jet inlet port, $A_{jop}$ is a cross-sectional area of a jet outlet port, $A_{rip}$ is a cross-sectional area of a rim inlet port, and $A_{rop}$ is a total cross-sectional area of an at least one rim outlet port, and the toilet bowl is capable of refilling at the end of a flush cycle having a reduced water volume, to achieve a seal depth that is greater than about 5 cm and a post-flush surface area of water in the bowl that is at least about 90% of an area obtained after completion of a full flush cycle.

2. The gravity flush toilet system according to claim 1, wherein the at least one fill valve has a refill ratio of greater than about 5% on a full flush cycle and greater than about 10% on a partial flush cycle, the system being capable of substantially restoring the seal depth and the surface area of water in the bowl.

3. The gravity flush toilet system according to of claim 1, wherein the system has at least one flush cycle that delivers no greater than about 6.0 liters.

4. The gravity flush toilet system according to claim 1, wherein the system has at least one flush cycle that delivers no greater than about 4.2 liters.

5. The gravity flush toilet system according to claim 1, wherein the toilet system is capable of providing two flush cycles, wherein a first flush cycle is capable of delivering no greater than about 6.0 liters and a second flush cycle is capable of delivering no greater than about 4.5 liters.

6. The gravity flush toilet system according to claim 1, wherein the toilet system is capable of providing two flush cycles, wherein a first flush cycle is capable of delivering no greater than about 4.8 liters and a second flush cycle is capable of delivering no greater than about 4.0 liters.

7. The gravity flush toilet system according to claim 1, wherein the peak flow rate measured at an outlet of the bowl during a siphon exceeds about 2750 ml/second and a time to achieve a peak flow rate is no greater than about 1.5 seconds.

8. The gravity flush toilet system according to claim 1, wherein one of the at least one fill valve in the tank is capable of diverting a variable percentage of water to refill the toilet bowl based on the flush cycle.

9. The gravity flush toilet system according to claim 8, wherein one of the at least two flush cycles is capable of delivering no greater than about 6.0 liters.

10. The gravity flush toilet system according to claim 8, wherein one of the at least two flush cycles is capable of delivering no greater than about 4.5 liters.

11. The gravity flush toilet system according to claim 8, wherein the toilet system has two flush cycles, a first flush cycle capable of delivering no greater than about 4.8 liters and a second flush cycle capable of delivering no greater than about 4.0 liters.

12. The gravity flush toilet system according to claim 8, wherein the toilet system has two flush cycles, a first flush cycle capable of delivering no greater than about 6.0 liters and a second flush cycle capable of delivering no greater than about 4.5 liters.

13. The gravity flush toilet system according to claim 8, wherein peak flow rate measured at an outlet of the bowl during a siphon exceeds about 2500 ml/second.

14. The gravity flush toilet system according to claim 1, wherein the $A_{rop}$ of the at least one rim outlet port is no greater than about 4.5 $cm^2$.

15. A gravity flush toilet system having at least two flush volumes, comprising a toilet bowl having an outlet and a tank, wherein the toilet system is a rim fed jet toilet system, and the tank comprises at least one fill valve and at least one flush valve, the system provides a surface area of water in the toilet bowl of at least about 200 $cm^2$ and a peak flow rate measured at an outlet of the bowl during a siphon of at least about 2500 ml/s and a flow rate of at least 2000 ml/s is achieved in no greater than about 1.75 seconds from initiation of a flush cycle, wherein internal cross-sectional area measurements within the toilet system are defined by the following relationship:

$$A_{pm}>35\ cm^2>A_{jip}>A_{jop}>6.4\ cm^2>A_{rop} \quad (V)$$

wherein $A_{pm}$ is a cross-sectional area of a primary manifold, $A_{jip}$ is a cross-sectional area of a jet inlet port, $A_{jop}$ is a cross-sectional area of a jet outlet port, and $A_{rop}$ is a total cross-sectional area of an at least one rim outlet port, and the toilet bowl is capable of refilling at the end of a flush cycle having a reduced water volume, to achieve a seal depth that is greater than about 5 cm and a post-flush surface area of water in the bowl that is at least about 90% of an area obtained after completion of a full flush cycle.

16. The gravity flush toilet system according to claim 15, wherein the at least one fill valve has a refill ratio of greater than about 5% on a full flush cycle and greater than about 10% on a partial flush cycle, the system being capable of substantially restoring the seal depth and the surface area of water in the bowl.

17. The gravity flush toilet system according to claim 15, wherein the toilet system is capable of providing two flush cycles, wherein a first flush cycle is capable of delivering no greater than about 6.0 liters and a second flush cycle is capable of delivering no greater than about 4.5 liters.

18. The gravity flush toilet system according to claim 15, wherein the toilet system is capable of providing two flush cycles, wherein a first flush cycle is capable of delivering no greater than about 4.8 liters and a second flush cycle is capable of delivering no greater than about 4.0 liters.

19. The gravity flush toilet system according to claim 15, wherein the $A_{rop}$ of the at least one rim outlet port is no greater than about 4.5 $cm^2$.

20. A method for providing at least two flush volumes to a gravity flush toilet, wherein that toilet includes a toilet bowl having an outlet, a tank, at least one fill valve, at least one flush valve, and a direct fed jet, wherein internal cross-sectional area measurements within the toilet system are defined by the following relationships:

$$A_{pm}>35\ cm^2>A_{jip}>A_{jop}>6.4\ cm^2 \quad (III)$$

$$A_{pm}>35\ cm^2>A_{rip}>A_{jop}>6.4\ cm^2>A_{rop} \quad (IV)$$

wherein $A_{pm}$ is a cross-sectional area of a primary manifold, $A_{jip}$ is a cross-sectional area of a jet inlet port, $A_{jop}$ is a cross-sectional area of a jet outlet port, $A_{rip}$ is a cross-sectional area of a rim inlet port, and $A_{rop}$ is a total cross-sectional area of an at least one rim outlet port, the method comprising providing a surface area of water in the toilet bowl of at least about 200 $cm^2$;

providing a peak flow rate measured at an outlet of the bowl during a siphon of at least about 2500 ml/s, and refilling the toilet bowl at the end of a flush cycle, regardless of flush volume of the at least two flush volumes so as to achieve a seal depth that is greater than about 5 cm and a post-flush surface area of water in the bowl of at least about 90% of an area obtained after a highest volume flush cycle.

21. A method for providing at least two flush volumes to a gravity flush toilet, wherein that toilet includes a toilet bowl having an outlet, a tank, at least one fill valve, at least one flush valve, and a rim fed jet, wherein internal cross-sectional area measurements within the toilet system are defined by the following relationships:

$$A_{pm}>35\ cm^2>A_{jip}>A_{jop}>6.4\ cm^2>A_{rop} \quad (V)$$

wherein $A_{pm}$ is a cross-sectional area of a primary manifold, $A_{jip}$ is a cross-sectional area of a jet inlet port, $A_{jop}$ is a cross-sectional area of a jet outlet port, and $A_{rop}$ is a total cross-sectional area of an at least one rim outlet port, the method comprising providing a surface area of water in the toilet bowl of at least about 200 $cm^2$;

providing a peak flow rate measured at an outlet of the bowl during a siphon of at least about 2500 ml/s; and refilling the toilet bowl at the end of a flush cycle, regardless of flush volume of the at least two flush volumes so as to achieve a seal depth that is greater than about 5 cm and a post-flush surface area of water in the bowl of at least about 90% of an area obtained after a highest volume flush cycle.

* * * * *